US009822596B2

(12) United States Patent
Clemens et al.

(10) Patent No.: US 9,822,596 B2
(45) Date of Patent: Nov. 21, 2017

(54) RELEASING A DOWNHOLE TOOL

(71) Applicant: Halliburton Energy Services, Inc., Houston, TX (US)

(72) Inventors: Jack Gammill Clemens, Fairview, TX (US); Bryan William Kasperski, Carrollton, TX (US); Matthew Craig Mlcak, Carrollton, TX (US); George Nathan Aldredge, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 201 days.

(21) Appl. No.: 14/430,656

(22) PCT Filed: Oct. 1, 2012

(86) PCT No.: PCT/US2012/058271
§ 371 (c)(1),
(2) Date: Mar. 24, 2015

(87) PCT Pub. No.: WO2014/055061
PCT Pub. Date: Apr. 10, 2014

(65) Prior Publication Data

US 2015/0247368 A1 Sep. 3, 2015

(51) Int. Cl.
*E21B 23/04* (2006.01)
*E21B 17/06* (2006.01)
(Continued)

(52) U.S. Cl.
CPC ..... *E21B 23/04* (2013.01); *E21B 17/06* (2013.01); *E21B 23/00* (2013.01); *E21B 23/14* (2013.01)

(58) Field of Classification Search
CPC ..... E21B 23/04; E21B 23/14; E21B 23/02; E21B 17/06; E21B 17/043
See application file for complete search history.

(56) References Cited

U.S. PATENT DOCUMENTS 3,211,222 A 10/1965 Myers
3,244,232 A 4/1966 Myers
(Continued)

FOREIGN PATENT DOCUMENTS

GB 1510694 5/1978

OTHER PUBLICATIONS

PCT International Preliminary Report on Patentability, PCT/US2012/058271, dated Apr. 16, 2015, 9 pages.
(Continued)

*Primary Examiner* — David Bagnell
*Assistant Examiner* — Manuel C Portocarrero
(74) *Attorney, Agent, or Firm* — Scott Richardson; Parker Justiss, P.C.

(57) ABSTRACT

Techniques for releasing a well tool string from a wireline release tool includes initiating actuation of a linear actuator of the wireline release tool, the actuator coupled to an inner mandrel on which a retractable latch rides, the retractable latch including a profile formed on an outer surface of the latch that is coupled to the well tool string; actuating the actuator to move the inner mandrel of the wireline release tool to remove support of the profile by a ramp formed on the outer surface, the profile retracted toward the inner mandrel based on the movement of the inner mandrel; decoupling the profile from the well tool string based on retraction of the profile toward the inner mandrel; and moving the wireline release tool into a position to release the wireline release tool from the well tool string.

26 Claims, 5 Drawing Sheets

(51) Int. Cl.
*E21B 23/00* (2006.01)
*E21B 23/14* (2006.01)

(56) References Cited

U.S. PATENT DOCUMENTS

| | | | | |
|---|---|---|---|---|
| 3,800,876 | A | 4/1974 | Eggleston | |
| 4,279,304 | A | 7/1981 | Harper | |
| 4,671,361 | A | 6/1987 | Bolin | |
| 4,756,363 | A | 7/1988 | Lanmon, II et al. | |
| 4,909,321 | A | 3/1990 | Petree | |
| 4,997,041 | A | 3/1991 | Petree | |
| 5,398,760 | A | 3/1995 | George et al. | |
| 5,509,481 | A | 4/1996 | Huber et al. | |
| 5,957,209 | A | 9/1999 | Burleson et al. | |
| 5,984,006 | A | 11/1999 | Read et al. | |
| 7,114,563 | B2 | 10/2006 | Rose | |
| 7,878,242 | B2 | 2/2011 | Gray | |
| 2010/0286800 | A1* | 11/2010 | Lerche | E21B 43/116 700/90 |
| 2011/0277986 | A1 | 11/2011 | Purkis | |

OTHER PUBLICATIONS

Clemens et al., "New Slickline Smart-Release Tool Mitigates Wire-Recovery Issues in Extreme Well Conditions," SPE 124966, Oct. 2009, 10 pages.

Expro, "Bridge Plug" copyright 2007, 1 page.

Gary et al., "Slickline-Conveyed Electromechanical Tool Utilization in Deepwater Gulf of Mexico," SPE 154421, Mar. 2012, 7 pages.

Thru-Tubing Systems, "Series 1200—Auto Release Tool" thrutubingsystems.com/intervention-products-and-services. php-?product=/wireline-products/series-12, copyright 2003, 2 pages.

Authorized Officer Jong Kyung Lee, PCT International Search Report and Written Opinion of the International Searching Authority, PCT/US2012/058271, dated Apr. 19, 2013, 12 pages.

* cited by examiner

RELEASING A DOWNHOLE TOOL

CROSS-REFERENCE TO RELATED APPLICATIONS

This application is a 371 U.S. National Phase Application of and claims the benefit of priority to International Application Serial No. PCT/US2012/058271, filed on Oct. 1, 2012 and entitled "Releasing a Downhole Tool", the contents of which are hereby incorporated by reference.

TECHNICAL BACKGROUND

This disclosure relates to releasing a downhole tool or tool string in a wellbore of a subterranean well system.

BACKGROUND

Downhole tools are used within a wellbore to assist the production of hydrocarbons from a hydrocarbon formation. Some common downhole tools are frac plugs, bridge plugs, and packers, which are used to seal a component against casing along the wellbore wall or to isolate one pressure zone of the formation from another.

It is frequently desirable to raise, lower, and/or release the downhole tools and equipment within the wellbore. For example, a downhole tool can be conveyed into the wellbore on a wireline, tubing, pipe, or another type of cable. In conventional systems, the operator estimates the location of the downhole tool based on this mechanical connection and, in some cases, also communicates with the tool through this electro-mechanical connection. For example, the operator may send communications to the downhole tool via the cable to command the release of the downhole tool. This mechanical connection may be subject to various problems including time consuming and costly operations, increased safety concerns, more personnel on site, and risk for breakage of the connection.

DETAILED DESCRIPTION

Figure 1:
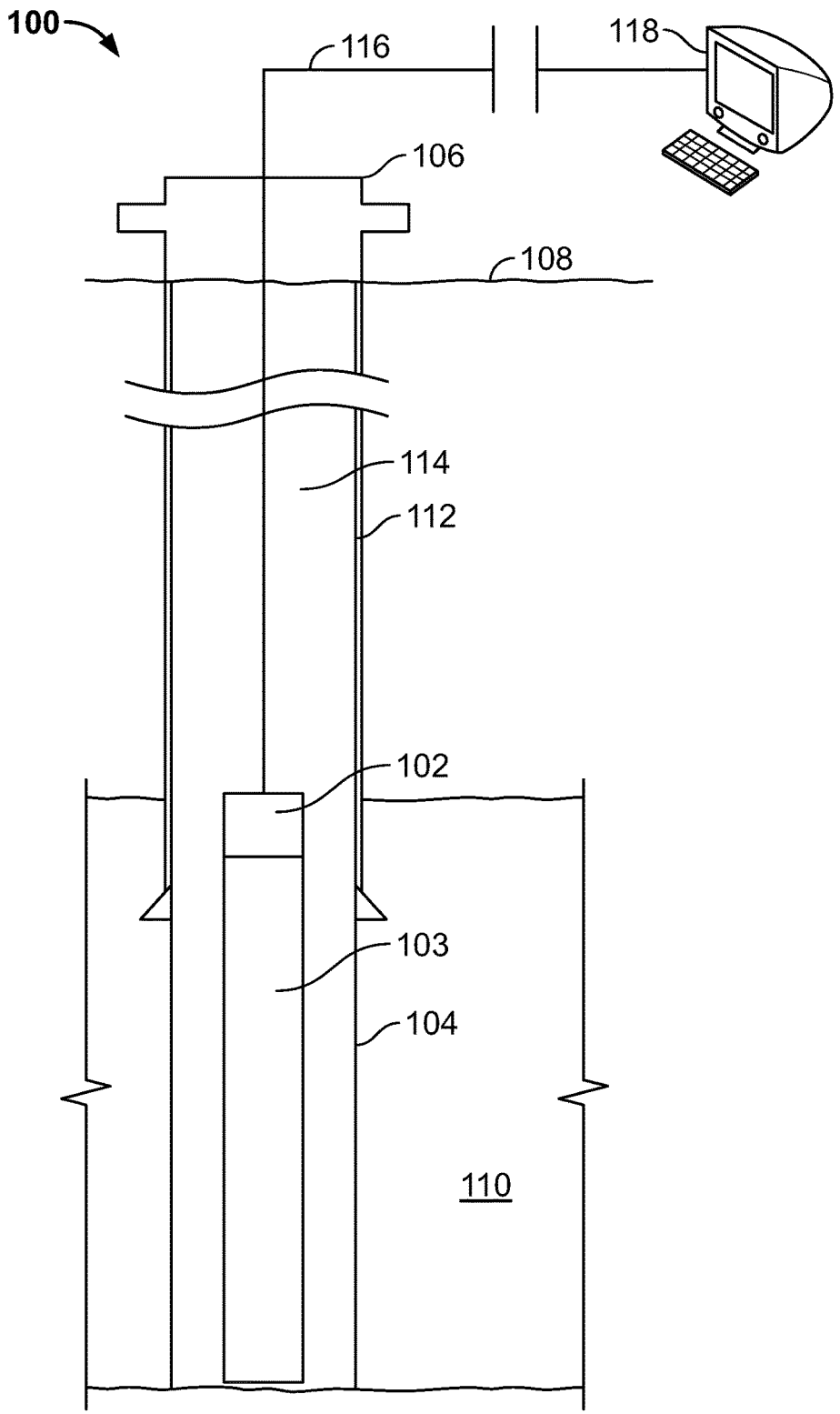
FIG. 1 is a cross-sectional view of an example well system that includes a release tool coupled to a tubular.

The present disclosure relates to releasing a downhole tool in a wellbore of a subterranean well system. In one general implementation, a wireline release tool includes a housing; an inner mandrel including a ramp on an outer surface of the mandrel; a retractable latch that rides on the mandrel and includes a profile formed on an outer surface of the latch, the profile adapted to couple to a wireline tool; and a linear actuator coupled to the mandrel and configured to adjust from an unactuated position to an actuated position, the profile of the latch supported by the ramp of the mandrel when the actuator is in the unactuated position, the mandrel moved by the linear actuator to remove support of the profile by the ramp when the actuator is in the actuated state, the profile adapted to decouple from the wireline tool when the actuator is in the actuated state.

In a first aspect combinable with the general implementation, the latch includes one of: a retainer dog; or a collet.

A second aspect combinable with any of the previous aspects includes an outer mandrel between the housing and the inner mandrel.

A third aspect combinable with any of the previous aspects includes a shear pin that fixes the inner mandrel to the outer mandrel, the actuator configured to exert a force on the inner mandrel to shear the shear pin to release the inner mandrel from the outer mandrel when the actuator adjusts from the unactuated position to the actuated position.

In a fourth aspect combinable with any of the previous aspects, the linear actuator includes a piston/cylinder assembly.

In a fifth aspect combinable with any of the previous aspects, the inner mandrel is coupled to the piston.

In a sixth aspect combinable with any of the previous aspects, the linear actuator is configured to adjust from the unactuated position to the actuated position in response to a pyrotechnic event.

In a seventh aspect combinable with any of the previous aspects, the linear actuator further includes a portion of gas proppant ignitable by the pyrotechnic event to exert a force to move the piston coupled to the mandrel from the first to the second position.

In an eighth aspect combinable with any of the previous aspects, the linear actuator further includes a linear actuator circuit that is coupled to a switch, the switch adjustable from an open position to a closed position to generate the pyrotechnic event.

In a ninth aspect combinable with any of the previous aspects, the linear actuator circuit includes a capacitor coupled in series with one or more timers.

In a tenth aspect combinable with any of the previous aspects, the linear actuator circuit includes a battery coupled across the capacitor.

In an eleventh aspect combinable with any of the previous aspects, the linear actuator circuit includes a transistor through which an energy stored in the capacitor flows to ignite a pyrotechnic initiator to generate the pyrotechnic event.

In a twelfth aspect combinable with any of the previous aspects, each of the one or more timers is associated with a duration of an activity performed wireline tool coupled to the well tool when the actuator is in the unactuated position.

A thirteenth aspect combinable with any of the previous aspects includes a top sub-assembly including a portion connectable to a wireline that extends from a terranean surface through a wellbore, the top sub-assembly coupled to the housing.

In a fourteenth aspect combinable with any of the previous aspects, where the linear actuator comprises one of a solenoid, a piezoelectric actuator, an electro-mechanical actuator, or a hydraulic cylinder.

In another general implementation, a method for releasing a well tool string from a wireline release tool includes initiating actuation of a linear actuator of the wireline release tool, the actuator coupled to an inner mandrel on which a retractable latch rides, the retractable latch including a profile formed on an outer surface of the latch that is coupled to the well tool string; actuating the linear actuator to move the inner mandrel of the wireline release tool to remove support of the profile by a ramp formed on the outer surface, the profile retracted toward the inner mandrel based on the movement of the inner mandrel; decoupling the profile from the well tool string based on retraction of the profile toward the inner mandrel; and moving the wireline release tool into a position to release the wireline release tool from the well tool string.

In a first aspect combinable with the general implementation, initiating the linear actuator comprises initiating the linear actuator with an explosive charge.

In a second aspect combinable with any of the previous aspects, the linear actuator of the wireline release tool includes a piston/cylinder assembly with the inner mandrel coupled to the piston.

A third aspect combinable with any of the previous aspects includes urging the piston from the cylinder with a determined force based on the explosive charge to shear a shear pin that fixes the inner mandrel to an outer mandrel of the wireline release tool.

A fourth aspect combinable with any of the previous aspects includes moving the inner mandrel downhole to remove support of the profile by the ramp formed on the outer surface.

In a fifth aspect combinable with any of the previous aspects, urging the piston from the cylinder with a determined force based on the explosive charge includes igniting a portion of gas proppant contained in the cylinder to produce an expanding gas; and directing the expanding gas against the piston to urge the piston from the cylinder at the determined force.

A sixth aspect combinable with any of the previous aspects includes initiating a time duration with a timer of an actuator circuit contained in the actuator subsequent to performance of the downhole operation with the wireline release tool string.

A seventh aspect combinable with any of the previous aspects includes closing a switch of the actuator circuit based on expiration of the time duration.

An eighth aspect combinable with any of the previous aspects includes igniting a pyrotechnic initiator of the actuator circuit to ignite the portion of gas proppant to generate the explosive charge.

A ninth aspect combinable with any of the previous aspects includes prior to moving the wireline release tool coupled to the well tool string through the wellbore, setting the timer with the time duration, the time duration including one of a plurality of time durations.

A tenth aspect combinable with any of the previous aspects includes moving the wireline release tool coupled to a well tool string through a wellbore.

An eleventh aspect combinable with any of the previous aspects includes performing a downhole operation with the well tool string in the wellbore.

In a twelfth aspect combinable with any of the previous aspects, initiating actuation of a linear actuator of the wireline release tool includes determining that an actuation event has been completed; and initiating actuation of the linear actuator based on the determination that the actuation event has been completed.

In a thirteenth aspect combinable with any of the previous aspects, the actuation event includes one or more of: a number of jars on the release tool equal to or greater than a threshold value; a tubing over pressure value equal to or greater than a threshold pressure value; an over pull value equal to or greater than a threshold pull value; or completion of a sequence of over pulls on a wireline coupled to the release tool.

In another general implementation, a system includes a well tool string that includes one or more well tools and a fishneck sub-assembly coupled to an uphole end of the well tool string, the fishneck sub-assembly including a shoulder defined on an inner surface of the fishneck sub-assembly near an uphole end of the fishneck sub-assembly. The system includes a release tool having a housing; an inner mandrel including a ramp on an outer surface of the mandrel; a retractable latch that rides on the mandrel and includes a profile formed on an outer surface of the latch, the profile adapted to couple to the fishneck sub-assembly; and a linear actuator coupled to the mandrel and configured to adjust from an unactuated position to an actuated position, the profile of the latch supported by the ramp of the mandrel and adjacent the shoulder of the fishneck sub-assembly to couple the release tool with the well tool string when the actuator is in the unactuated position, the mandrel moved by the linear actuator to remove support of the profile by the ramp when the actuator is in the actuated state.

In a first aspect combinable with the general implementation, the latch of the release tool includes one of a retainer dog or a collet.

In a second aspect combinable with any of the previous aspects, the release tool further includes an outer mandrel between the housing and the inner mandrel; and a shear pin that fixes the inner mandrel to the outer mandrel, the actuator configured to exert a force on the inner mandrel based on the explosive event to shear the shear pin to release the inner mandrel from the outer mandrel when the actuator adjusts from the unactuated position to the actuated position.

In a third aspect combinable with any of the previous aspects, the linear actuator includes a piston/cylinder assembly, and the inner mandrel is coupled to the piston.

In a fourth aspect combinable with any of the previous aspects, the linear actuator is configured to adjust from the unactuated position to the actuated position in response to an explosive event.

In a fifth aspect combinable with any of the previous aspects, the linear actuator further includes a portion of gas proppant ignitable to exert a force to move the piston coupled to the mandrel from the first to the second position; and a linear actuator circuit that is coupled to a switch, the switch adjustable from an open position to a closed position to ignite the gas proppant and generate the explosive event.

In a sixth aspect combinable with any of the previous aspects, the linear actuator circuit includes a capacitor coupled in series with one or more timers; a battery coupled across the capacitor; and a transistor through which an energy stored in the capacitor flows to ignite a pyrotechnic initiator to generate the explosive event.

In a seventh aspect combinable with any of the previous aspects, each of the one or more timers is associated with a duration of an activity performed by the one or more well tools coupled to the release tool when the actuator is in the unactuated position.

In an eighth aspect combinable with any of the previous aspects, the release tool further includes a top sub-assembly including a portion connectable to a wireline that extends from a terranean surface through a wellbore, the top sub-assembly coupled to the housing.

In a ninth aspect combinable with any of the previous aspects, the linear actuator comprises one of a solenoid, a piezoelectric actuator, an electro-mechanical actuator, or a hydraulic cylinder.

Various implementations of a well tool in accordance with the present disclosure may include one, some, or all of the following features. For example, the well tool may include a release mechanism, which can be initiated by an actuation signal. In some implementations, the actuation signal can be initiated by a user of a control unit. In some implementations, the well tool can be autonomous and self-activate the release of a downhole tool string without requiring the command of a control unit. For example, the well tool can include a timer, which can initiate the release of the downhole tool string at a particular time selected prior, during, and/or after the operation of the downhole tubular. In some implementations, a top end of the downhole tool string may include a fishneck sub-assembly that is coupled to the release tool. Once released, a fishneck sub-assembly may be exposed for retrieval, e.g., with a fishing tool or with other devices.

FIG. 1 is a cross-sectional view of a well system 100 with an example downhole assembly including a release tool and a downhole tool string constructed in accordance with the concepts herein. The well system 100 is provided for convenience of reference only, and it should be appreciated that the concepts herein are applicable to a number of different configurations of well systems. As shown, the well system 100 includes a release tool 102 within a substantially cylindrical wellbore 104 that extends from a well head 106 at a terranean surface 108 through one or more subterranean zones of interest 110. In FIG. 1, the wellbore 104 extends substantially vertically from the terranean surface 108. However, in other instances, the wellbore 104 can be of another position, for example, deviates to horizontal in the subterranean zone 110, entirely substantially vertical or slanted, it can deviate in another manner than horizontal, it can be a multi-lateral, and/or it can be of another position.

At least a portion of the illustrated wellbore 104 may be lined with a casing 112, constructed of one or more lengths of tubing, that extends from the well head 106 at the terranean surface 108, downhole, toward an end of the wellbore 104. The casing 112 provides radial support to the wellbore 104 and seals against unwanted communication of fluids between the wellbore 104 and surrounding formations. Here, the casing 112 ceases at or near the subterranean zone 110 and the remainder of the wellbore 104 is an open hole, e.g., uncased. In other instances, the casing 112 can extend to the bottom of the wellbore 104 or can be provided in another position.

As illustrated, the downhole assembly is coupled to a conveyance 116 such as a wireline, a slickline, an electric line, a coiled tubing, straight tubing, or the like. The downhole assembly includes a release tool 102 and a downhole tool string 103. The release tool 102 can raise, lower and/or release a downhole tool string 103 within the wellbore 104.

In some implementations, the downhole tool string 103 can be lowered by the release tool 102 with a conveyance 116 from the terranean surface 108 and then released into the wellbore to descend down the wellbore 104 or remain at a particular position in the wellbore. In some implementations, the release tool 102 may be coupled to the conveyance 116 (e.g., wireline such as slickline) through, for example, a rope socket or other coupling device.

In some implementations, the downhole tool string 103 can be deployed by the release tool 102 into the wellbore 104 via a lubricator (not shown) or simply dropped into the wellbore 104. Then gravity may provide or help provide an external force for moving the downhole tool string 103 along at least a partial length of the wellbore 104.

The release tool 102 includes a release mechanism, which can be initiated by an actuation signal. In some implementations, the actuation signal can be sent from the control unit 118 to the release tool 102 (e.g., electrical signals sent over the conveyance 116). The control unit can be a system based on a microprocessor, a mechanical, or an electro mechanical controller. In some implementations, the release tool 102 can communicate with the control unit 118 located on the terranean surface 108, allowing a user of the control unit 118 to initiate the release of the downhole tool by sending the actuation signal. Further, although shown in the illustrated example as located above-ground (e.g., on the terranean surface 108), the control unit 118 (or other control system similar to the control unit 118) may be located in the release tool 102 or in another portion of a tool string that includes the release tool 102. For instance, the control unit 118 may include or comprise an autonomous programmable unit (e.g., PCB, controller, field programmable ASIC, or otherwise) located in the release tool 102 uphole of, for instance, a release mechanism of the tool 102.

In some implementations, the release tool 102 can be autonomous and self-activate the release of the downhole tool 103 without requiring the command of a control unit 118 located on the terranean surface 108. For example, the release tool 102 can include a timer, which can initiate the release of the downhole tool at a particular time (e.g., 6 hours after the release and downhole tool downhole assembly began to descend in the downhole). The release tool 102 can be battery powered and can be pre-job programmed to release from the downhole tool string 103 after a predetermined time has lapsed. The time allowed can depend on the type of operation being performed and/or the velocity at which the downhole assembly descends. In some examples, the release tool 102 can include a detector, which can initiate the release of the downhole tool string 103 based on the location. In some implementations, the release tool 102 can include a selection of timers, based on job specific parameters. For example, a timer may be activated only after other procedures have failed to retrieve the release tool and the downhole tool string. In some implementations, the release tool 102 can have multiple preset timers that an operator can choose to implement.

In some implementations, decoupling of the release tool 102 from the downhole tool string 103 may allow for easier retrieval of the downhole tool string 103 from the wellbore 104. For example, a top end of the downhole tool string 103 may include a fishneck sub-assembly that is coupled to the release tool 102. Once released, the fishneck sub-assembly may be exposed for retrieval, e.g., with a fishing tool or other device.

Figure 2A:
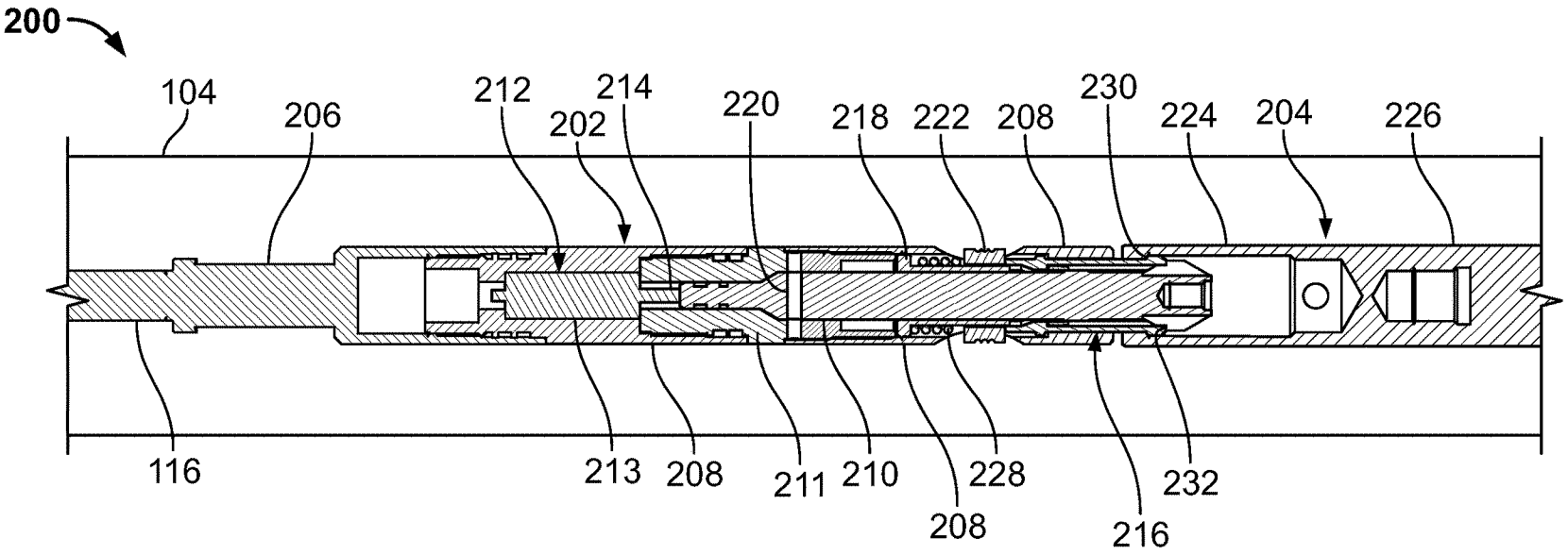
FIGS. 2A-2C are cross-sectional views of an example release tool.
Figure 2B:
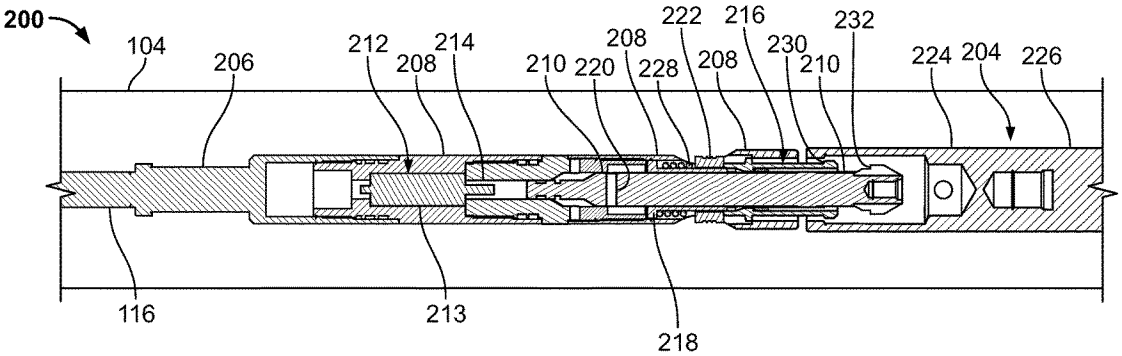
Figure 2C:
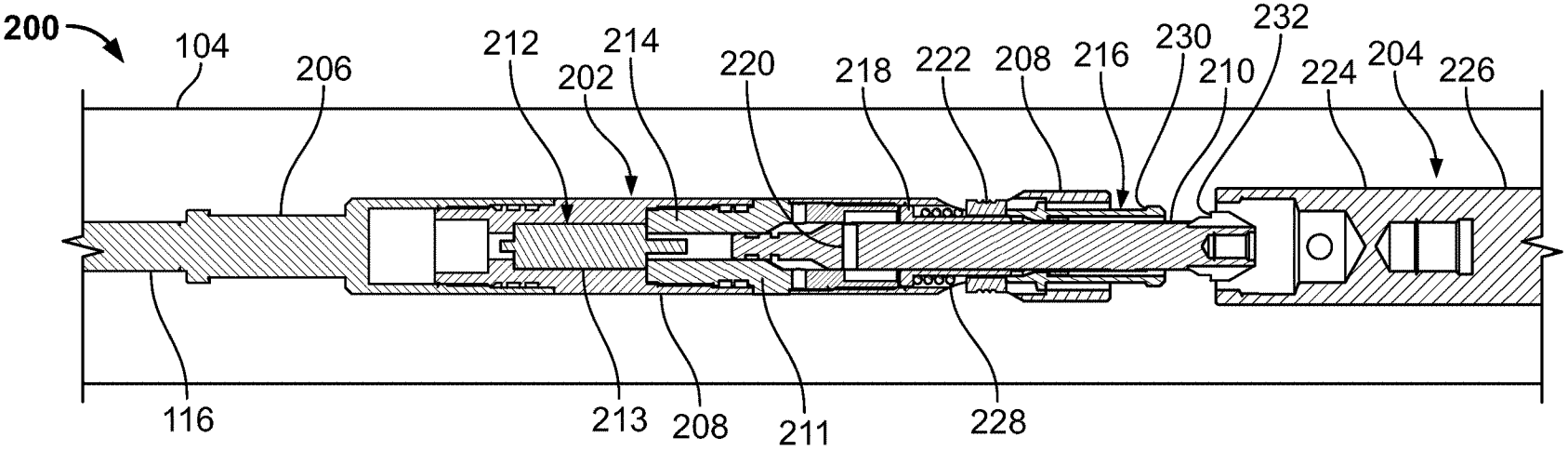

Turning now to FIGS. 2A-2C, an example of a downhole assembly 200 including a release tool 202 and a downhole tool string 204 is depicted in cross-section. FIGS. 2A-2C show the example downhole assembly in a run-in position, an actuated position, and a released position, respectively.

The downhole assembly 200 is illustrated as being in the wellbore 104. The downhole assembly 200 includes a release tool 202 coupled to a downhole tool string 204 (in the run-in position in FIG. 2A). As explained more fully below, the release tool 202, which is coupled to the conveyance 116, is coupled to the downhole tool string 204 in the run-in position (e.g., for moving the tool string 204 into the wellbore 104, during one or more operations of the downhole tool string 204, and, in some instances, during a trip out of the hole. In the case, for example, of completion of one or more operations (e.g., a completion operation such as a perforating job), it may be desirable to decouple the release tool 202 from the downhole tool string 204. As another example, if all or part of the downhole tool string 204 becomes stuck in the wellbore, and a fishing operation is necessary, the release tool 202 may be adjusted to the actuated position (as shown in FIG. 2B) in which the tool 202 is decoupled from the downhole tool string 204. Once decoupled from the downhole tool string 204, the release tool 202 may be further moved into the release position (shown in FIG. 2C) such that, for instance, a fishneck of the downhole tool string 204 is exposed.

The release tool 202 includes a housing 208 that extends all or a portion of the length of the release tool 202. The housing 208, in this example, is shown as made up of multiple parts for convenience of construction, and in other instances, could be made of fewer or more parts. An upper sub-assembly 206 is coupled (e.g., threadingly) to at least a portion of the housing 208 and also to the conveyance 116.

The components of the illustrated release tool 202 further include an outer mandrel 211, an inner mandrel 210 that includes a shoulder (or profile) 232 on a downhole end of the mandrel 210, and a linear actuator 212. The example linear actuator 212 includes a cylinder 213 with a piston 214 extending at least partly from the cylinder 213. The release tool 202 further includes a collet 216 with a profile 230, a sleeve 218, a shear pin 220, a release tab 222, and a biasing member 228. As shown in FIG. 2A, the collet 216, the sleeve 218, the release tab 222, and the biasing member 228 are carried on the inner mandrel 210, which is coupled to the piston 214.

Generally, the downhole tool string 204 includes one or more downhole tools 226 that are coupled at an uphole end to a fishneck assembly 224. The fishneck assembly 224 includes, as illustrated, a shoulder that faces downhole.

Referring to FIG. 2A, the release tool 202 is shown in the example run-in position coupled to the downhole tool string 204. In the example run-in position, the shear pin 220 is intact and couples the inner mandrel 210 to the outer mandrel 211, thereby constraining the mandrel 210 with substantially no movement uphole or downhole. In the run-in position, the ramp of the inner mandrel 210 is positioned under the collet 216 such that the collet 216 abuts the shoulder on an interior surface of the fishneck assembly 224. The collet 216 also abuts a shoulder on the housing 208 to constrain the movement of the release tool 202, thereby coupling the release tool 202 with the downhole tool string 204 in the run-in position.

Referring to FIG. 2B, the release tool 202 is shown in an example actuated position. In the actuated position, the release tool 202 is decoupled, partially decoupled, or positioned to be decoupled, from the downhole tool string 204. In the example actuated position, the linear actuator 212 is actuated (e.g., by an explosive charge, a pyrotechnic actuator, or otherwise) to urge the piston 213 out of the cylinder 214. The piston 213 is urged further from the cylinder 214 at sufficient force on the mandrel 210 (coupled to the piston 213) to shear the shear pin, releasing the mandrel from being constrained within the housing. As illustrated in FIG. 2B, the downhole tool string 204 is still attached to the release tool 202, the shoulder 232 of the inner mandrel 211 is coupled to the fishneck downhole assembly 224 and the collet 216 with the profile 230 constrains the movement of the release tool 202.

Referring to FIG. 2C, the downhole assembly is shown in an example released position. In the released position, the release tool 202 is at least partially or completely decoupled from the downhole tool string 204. As shown in FIG. 2B, the ramp of the mandrel 210 is adjusted downhole to withdraw support of the collet 216 abutting the shoulder of the lower fishneck sub-assembly 224. The downhole tool string 204 is detached from the release tool 202 and the release tool 202 may be moved uphole to decouple from the downhole tool string 204.

In some implementations, the release tool 202 may be actuated independently using a battery. For example, the battery may power a control circuit (e.g., PCB) that controls operation of the linear actuator 212. In some implementations, the performance of the battery used to power the release tool 202 is tested prior to insertion in the release tool 202. In some implementations, the battery used to power the release tool 202 can provide high current, low internal resistance, long life cycle, soak time, self-discharge capabilities and no thermal runaway. Several types of batteries can be used. In some implementations, the battery type can be chosen based on its capacity, voltage profile, cycle life, soak time, self-discharge, and hydrostatic crush. For example, the incorporation of alkaline batteries in the release tool 202 would have the advantage that this type of batteries has high energy storage rates, are commercially available, and have no transportation restrictions. However, the usage of alkaline batteries is limited by ambient temperature, which may require the housing 208 to maintain the temperature within the release tool 202 under a particular limit. In some examples, primary (non-rechargeable) lithium batteries can be used to power the release tool. Primary lithium batteries have a high-energy density, have no usage safety concerns but require controlled disposal after use. In some examples, phosphate-based lithium rechargeable batteries can be used to power the release tool. For example, the nano-structured rechargeable batteries can be used in a smart-release tool 202 that effectuates downhole operations where temperature is less than 130° C., and duration of its use is less than 2 weeks.

In some implementations, the linear actuator 212 can be a timer that closes an activation circuit (as described in further detail with reference to FIG. 3) to actuate the linear actuator 212 (e.g., urge the piston 214 from the cylinder 213 with sufficient force to shear the shear pin 220). Several types of linear actuators 212 can be used. In some implementations, the selection of the linear actuators 212 can be based on job-specific parameters. In some implementations, the linear actuator 212 activates after normal conveyance procedures have failed to retrieve the stuck tool string. In some implementations, the linear actuator 212 may include a timer or, in some aspects, several timers (e.g. one timer for 6 hours, one for 24 hours and one timer for 48 hours). For example, each timer can correspond to a preset time duration, allowing adequate operational time for the selected operation of the downhole tool string 204.

In some implementations, the linear actuator 212 can include a location detector (e.g., depth detector), capable to actuate the linear actuator 212 at a particular location. In some implementations, the release tool comprises a linear actuator 212 capable to receive and further emit the actuation signals generated outside the release tool (as described with reference to FIG. 1). In some implementations, the release tool 202 can be designed to be "fail safe," such that if there is any failure in the system (e.g., battery, or any other part) the linear actuator 212 is not actuated.

The activation circuit can be a printed circuit board with activation logic, as described in detail with reference to FIG. 3. In some implementations, when an actuation signal is received (e.g. from a timer, an activation pressure, an electrical signal, etc.) the activation circuit creates a spark, which ignites a pyrotechnic initiator (e.g. ZPP, BPN, aluminum-potassium perchlorate, titanium-aluminum-potassium perchlorate or other pyrogen substances). The pyroenergy is converted to mechanical energy, which is rapidly deployed to disengage the release tool.

In some implementations, the mechanical energy is transmitted to a piston 214 to urge the piston further from the cylinder 213 at a particular force. The force is transferred to the inner mandrel 210 which, in the run-in position, is fixed to the outer mandrel 211 with the shear pin 220. Under the force applied to the mandrel 210 with the piston 214, the shear pin 220 shears, allowing the mandrel 210 to move downhole. When moved downhole, support of the collet 216 against the shoulder of the fishneck assembly 224 by the mandrel 210 is withdrawn, causing the collet 216 to snap radially inward.

In another example operation, the release tool 202 may be manually released from the downhole tool string 204. For example, in some implementations, actuation of the release tab 222 may decouple the release tool 202 from the downhole tool string 204. For instance, the release tab 222 may be forcibly depressed in an uphole direction against the biasing member 228 (e.g., a spring or set of springs, such as a coil spring, Belleville washers, or other springs). The biasing member 228 receives the force from the release tab 222 and contracts, thereby providing a space between the release tab 222 and the collet 216. The collet 216 may then collapse as it is no longer constrained against the release tab 222. Subsequent to collapsing, the collet 216 releases the fishneck assembly 224.

In another example operation, the release tool 202 may be hydraulically released from the downhole tool string 204. For example, in some implementations, the linear actuator 212 may be actuated by a hydraulic force (e.g., fluid entering the release tool 202 from an annulus between the tool 202 and the wellbore 104 at a particular pressure). The fluid may, for instance, enter the tool 202 through a shear disk that ruptures at the particular pressure. The fluid may then urge the piston 214 downward to apply force to the inner mandrel 210 to shear the shear pin 220. In an alternative implementation, the linear actuator 212 may be removed from the release tool 202, and the fluid pressure may act directly on a surface of the inner mandrel 210 to urge the mandrel 210 downhole to shear the shear pin 220.

Figure 3:
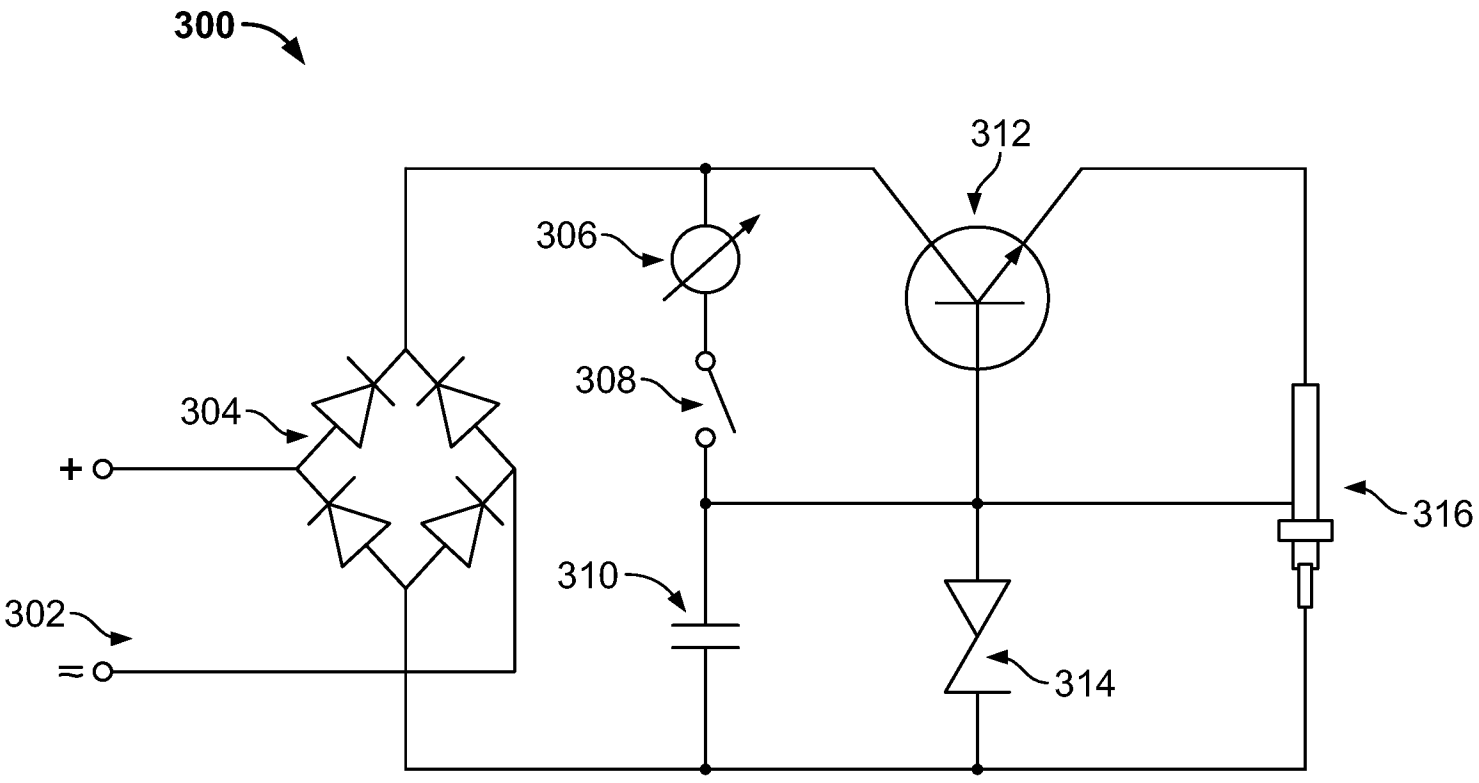
FIG. 3 is a detailed view of an example timing circuit for a downhole assembly.

Referring now to FIG. 3, an example activation circuit 300 for actuating the linear actuator 212 is shown. The example activation circuit 300 can be implemented, for example, as a timer in the linear actuator 212 shown in FIGS. 2A-2C. As seen in FIG. 3, the circuit 300 is powered by a power source 302 and includes a semiconductor bridge 304, a timer 306, a switch 308, a capacitor 310, a transistor 312, a protection component 314, and a pyrotechnic initiator 316.

In some implementations, the semiconductor bridge 304 is used to rectify the input current received from a source 302 (e.g., a battery such as a 1.45 V zinc battery). In some implementations, the circuit 300 is open until an actuation signal is received. In some implementations, the actuation signal is generated by the timer 306. The timer 306 can produce an actuation signal to open or close the switch. In some implementations, at the closure of the switch 308 the energy stored in the capacitor 310 is discharged, generating a flow of current through the transistor 312. In some implementations, the circuit 300 includes a protection component 314 (e.g. a Zener diode or a resistor) that prevents any back electro-motive force (e.g. reverse voltage) from damaging the transistor.

In some implementations, the output signal generated by the transistor 312 activates the pyrotechnic initiator 316. The activation of the pyrotechnic initiator 316 initiates a rapid volumetric increase in a flammable gas (e.g., propane, methane, butane, acetylene), stored in, for instance, the cylinder 213 of the linear actuator 212, to urge the piston 214 out of the cylinder 213 with a particular force. The magnitude of the force is sufficient to activate the release of the downhole tool (as described with respect to FIGS. 2A-2C). In some implementations, the magnitude of the force can be controlled through the volume and the concentration of the flammable gas.

In some implementations, the activation circuit 300 can be initiated, as described above, based on a timer or one of multiple timers. In some implementations, the activation circuit 300 can be initiated by pressure. For instance, the release tool 202 may include or be coupled with a pressure sensor that senses a tubing pressure (e.g., of the tool string 204). Once a particular pressure is sensed (e.g., a pressure that creates a tubing over pressure), then the activation circuit 300 may be initiated. As another example, the activation circuit 300 can be initiated based on a jar count. For example, the activation circuit 300 or other portion of the tool 202 may count a number of jars on the release tool 202 (e.g., by another well tool that is used to impart a heavy blow or "jar" to the release tool 202). As yet another example, the activation circuit 300 can be initiated based on an over pull over a defined value on a wireline that is connected to the release tool 202. For instance, if a pull force (e.g., on the wireline to move the tool 202 in an uphole direction) is greater than a particular value, the activation circuit 300 may be initiated. As another example, the activation circuit 300 can be initiated based on a sequence of line over pulls on a wireline that is connected to the release tool 202. For instance, there may be a defined sequence (e.g., based on frequency and/or amplitude of the over pulls) that may initiate the activation circuit 300.

A number of examples have been described. Nevertheless, it will be understood that various modifications may be made. For example, although component 216 is described as a collet, other members having profiles that can couple to the fishneck assembly 224 may also be used, such as, for example, dogs or shear members. As another example, although the linear actuator 212 is described in the example implementation as having an explosive, or pyrotechnic, charge that is used to initiate actuation, other linear actuators may be used in place of or in addition to an explosively-actuated linear actuator. For instance, in some implementations, the linear actuator may be a solenoid-actuated device. In some implementations, the linear actuator may be a hydraulically-actuated device. Further, in some implementations, the linear actuator may be a piezoelectric actuator or an electro-mechanical actuator. Accordingly, other examples are within the scope of the following claims.

What is claimed is:

1. A wireline release tool, comprising:

a housing;

an inner mandrel located within the housing and comprising a ramp on an outer surface of the inner mandrel;

a retractable latch that rides on the inner mandrel and comprises a profile formed on an outer surface of the latch, the profile couplable to a wireline tool; and a linear actuator located within the housing and having a cylinder with a piston located therein that is extendable at least partly from the cylinder and engageable against the inner mandrel, the piston being movable from an unactuated position to an actuated position which applies a force against the inner mandrel when in the actuated position, the profile of the latch supported by the ramp of the mandrel when the actuator is in the unactuated position, the mandrel movable by the linear actuator to remove support of the profile by the ramp when the linear actuator is in the actuated state, the profile decouplable from the wireline tool when the linear actuator is in the actuated state.

2. The wireline release tool of claim 1, where the latch comprises one of:

a retainer dog or a collet.

3. The wireline release tool of claim 1, further comprising:

an outer mandrel coupled to the housing and the inner mandrel and located between the housing and the inner mandrel; and a shear pin that fixes the inner mandrel to the outer mandrel and being shearable when the linear actuator exerts the force on the inner mandrel to release the inner mandrel from the outer mandrel when the actuator adjusts from the unactuated position to the actuated position.

4. The wireline release tool of claim 1, where the linear actuator is adjustable from the unactuated position to the actuated position in response to a pyrotechnic event.

5. The wireline release tool of claim 4, where the linear actuator further comprises:

a portion of gas proppant ignitable by the pyrotechnic event to exert the force to move the piston coupled to the mandrel from the unactuated position to the actuated position;

a linear actuator circuit that is coupled to a switch, the switch adjustable from an open position to a closed position to generate the pyrotechnic event.

6. The wireline release tool of claim 5, where the linear actuator circuit comprises:

a capacitor coupled in series with one or more timers;

a battery coupled across the capacitor; and a transistor through which an energy stored in the capacitor flows to ignite the pyrotechnic initiator to generate the pyrotechnic event.

7. The wireline release tool of claim 4, where each of one or more timers is associated with a duration of an activity performed by the wireline tool coupled to the well tool when the actuator is in the unactuated position.

8. The wireline release tool of claim 1, further comprising:

a top sub-assembly comprising a portion connectable to a wireline that extends from a terranean surface through a wellbore, the top sub-assembly coupled to the housing.

9. The wireline release tool of claim 1, where the linear actuator comprises one of a solenoid, a piezoelectric actuator, an electro-mechanical actuator, or a hydraulic cylinder.

10. A method for releasing a well tool string from a wireline release tool, comprising:

initiating actuation of a linear actuator of the wireline release tool located within a housing and having a cylinder with a piston located therein that is extendable at least partly from the cylinder and engageable against an inner mandrel on which a retractable latch rides, the retractable latch comprising a profile formed on an outer surface of the latch that is coupled to the well tool string;

exerting a force against the inner mandrel with the piston to move the inner mandrel of the wireline release tool to remove support of the profile by a ramp formed on the outer surface, the profile retracted toward the inner mandrel based on the movement of the inner mandrel;

decoupling the profile from the well tool string based on retraction of the profile toward the inner mandrel; and moving the wireline release tool into a position to release the wireline release tool from the well tool string.

11. The method of claim 10, where initiating the linear actuator comprises initiating the linear actuator with an explosive charge.

12. The method of claim 11, wherein exerting a force against the inner mandrel comprises urging the piston from the cylinder with a determined force based on the explosive charge to shear a shear pin that fixes the inner mandrel to an outer mandrel of the wireline release tool; and moving the inner mandrel downhole to remove support of the profile by the ramp formed on the outer surface.

13. The method of claim 12, where exerting the piston from the cylinder with a determined force based on the explosive charge comprises:

igniting a portion of gas proppant contained in the cylinder to produce an expanding gas; and directing the expanding gas against the piston to urge the piston from the cylinder at the determined force.

14. The method of claim 13, further comprising:

initiating a time duration with a timer of an actuator circuit contained in the linear actuator subsequent to performance of the downhole operation with the wireline release tool string;

closing a switch of the actuator circuit based on expiration of the time duration; and igniting a pyrotechnic initiator of the actuator circuit to ignite the portion of gas proppant to generate the explosive charge.

15. The method of claim 14, further comprising:

prior to moving the wireline release tool coupled to the well tool string through the wellbore, setting the timer with the time duration, the time duration comprising one of a plurality of time durations.

16. The method of claim 10, further comprising:

moving the wireline release tool coupled to a well tool string through a wellbore; and performing a downhole operation with the well tool string in the wellbore.

17. The method of claim 10, where initiating actuation of a linear actuator of the wireline release tool comprises:

determining that an actuation event has been completed; and initiating actuation of the linear actuator based on the determination that the actuation event has been completed.

18. The method of claim 17, where the actuation event comprises one or more of:

a number of jars on the release tool equal to or greater than a threshold value;

a tubing over pressure value equal to or greater than a threshold pressure value;

an over pull value equal to or greater than a threshold pull value; or completion of a sequence of over pulls on a wireline coupled to the release tool.

19. A system comprising:

a well tool string, comprising:

one or more well tools; and a fishneck sub-assembly coupled to an uphole end of the well tool string, the fishneck sub-assembly comprising a shoulder defined on an inner surface of the fishneck sub-assembly near an uphole end of the fishneck sub-assembly; and a release tool, comprising:

a housing;

an inner mandrel comprising a ramp on an outer surface of the mandrel;

a retractable latch that rides on the mandrel and comprises a profile formed on an outer surface of the latch, the profile adapted to couple to the fishneck sub-assembly; and a linear actuator located within the housing and having a cylinder with a piston located therein that is extendable at least partly from the cylinder and engageable against the inner mandrel the piston being movable from an unactuated position to an actuated position, the profile of the latch supported by the ramp of the mandrel and adjacent the shoulder of the fishneck sub-assembly to couple the release tool with the well tool string when the linear actuator is in the unactuated position, the mandrel moved by the linear actuator to remove support of the profile by the ramp when the actuator is in the actuated position.

20. The system of claim 19, where the latch of the release tool comprises one of a retainer dog or a collet.

21. The system of claim 19, where the release tool further comprises:

an outer mandrel between the housing and the inner mandrel; and a shear pin that fixes the inner mandrel to the outer mandrel, the linear actuator configured to exert a force on the inner mandrel based on the explosive event to shear the shear pin to release the inner mandrel from the outer mandrel when the linear actuator adjusts from the unactuated position to the actuated position.

22. The system of claim 19, where the linear actuator further comprises:

a portion of gas proppant ignitable to exert a force to move the piston coupled to the mandrel from the first to the second position; and a linear actuator circuit that is coupled to a switch, the switch adjustable from an open position to a closed position to ignite the gas proppant and generate the explosive event.

23. The system of claim 22, where the linear actuator circuit comprises:

a capacitor coupled in series with one or more timers;

a battery coupled across the capacitor; and a transistor through which an energy stored in the capacitor flows to ignite a pyrotechnic initiator to generate the explosive event.

24. The system of claim 22, where each of the one or more timers is associated with a duration of an activity performed by the one or more well tools coupled to the release tool when the actuator is in the unactuated position.

25. The system of claim 19, where the release tool further comprises a top sub-assembly comprising a portion connectable to a wireline that extends from a terranean surface through a wellbore, the top sub-assembly coupled to the housing.

26. The system of claim 19, where the linear actuator comprises one of a solenoid, a piezoelectric actuator, an electro-mechanical actuator, or a hydraulic cylinder.

* * * * *